US010215459B2

(12) United States Patent
Shin

(10) Patent No.: US 10,215,459 B2
(45) Date of Patent: Feb. 26, 2019

(54) VEHICLE CONDENSER

(71) Applicant: Hanon Systems, Daejeon (KR)

(72) Inventor: Sung Hong Shin, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 15/966,143

(22) Filed: Apr. 30, 2018

(65) Prior Publication Data

US 2018/0245828 A1 Aug. 30, 2018

Related U.S. Application Data

(62) Division of application No. 15/099,632, filed on Apr. 15, 2016.

(30) Foreign Application Priority Data

Apr. 15, 2015 (KR) ..... 10-2015-0053276

(51) Int. Cl.

| | |
|---|---|
| ***F25B 39/04*** | (2006.01) |
| ***F28F 9/00*** | (2006.01) |
| ***F28F 9/013*** | (2006.01) |
| ***F28D 1/053*** | (2006.01) |
| *F28D 21/00* | (2006.01) |

(52) U.S. Cl.

CPC ..... *F25B 39/04* (2013.01); *F28D 1/05366* (2013.01); *F28F 9/001* (2013.01); *F28F 9/002* (2013.01); *F28F 9/0131* (2013.01); *F25B 2339/00* (2013.01); *F25B 2339/0441* (2013.01); *F28D 2021/0084* (2013.01)

(58) Field of Classification Search

CPC ..... F28F 9/0131; F28F 9/001; F25B 2339/00; F25B 2339/0441

See application file for complete search history.

(56) References Cited

U.S. PATENT DOCUMENTS 6,357,520 B1 * 3/2002 Kato ..... F28F 9/001 165/149
2006/0272801 A1 * 12/2006 Ikawa ..... B23K 1/0012 165/149
2011/0214848 A1 9/2011 Ninagawa et al.

FOREIGN PATENT DOCUMENTS

JP 2001004293 A * 1/2001 ..... F28F 9/001

* cited by examiner

*Primary Examiner* — Keith M Raymond
*Assistant Examiner* — Nael N Babaa
(74) *Attorney, Agent, or Firm* — Shumaker, Loop & Kendrick, LLP; James D. Miller

(57) ABSTRACT

Disclosed herein is a vehicle condenser in which a notch portion of each coupling part of a pair of supports installed at the outermost sides of radiation fins extends so as to have a certain length from the tip of a body part to the inside end of the notch portion, or a through-hole is formed so as to be spaced by a predetermined distance toward the inside of the body part from the tip thereof, thereby preventing the radiation fins from melting when the clad on a header of a header tank is melted during the brazing of the radiation fins and flows along an embossing part, regardless of a method for manufacturing the supports. Consequently, it is possible to reduce the failure rate of the condenser and increase the efficiency of the condenser by maintaining the original state of the radiation fins.

6 Claims, 7 Drawing Sheets

VEHICLE CONDENSER

CROSS-REFERENCE TO RELATED APPLICATION

This patent application is a divisional patent application of U.S. patent application Ser. No. 15/099,632 file Apr. 15, 2016 which claims priority to Korean Patent Application No. 10-2015-0053276 filed on Apr. 15, 2015, the disclosure of each of which is incorporated herein by reference in its entirety.

BACKGROUND OF THE INVENTION

Field of the Invention

Exemplary embodiments of the present invention relate to a vehicle condenser, and more particularly, to a vehicle condenser in which a notch portion of each coupling part of a pair of supports installed at the outermost sides of radiation fins extends so as to have a certain length from the tip of a body part to the inside end of the notch portion, or a through-hole is formed so as to be spaced by a predetermined distance toward the inside of the body part from the tip thereof, thereby preventing the radiation fins from melting when the clad on a header of a header tank is melted during the brazing of the radiation fins and flows along an embossing part and reducing the failure rate of the condenser.

Description of the Related Art

In general, a heat exchange system is a system which absorbs heat in one of two environments having different temperatures and discharges the heat to the other thereof. The heat exchange system acts as a cooling system when heat is absorbed from the interior to be discharged to the exterior, while acting as a heating system when heat is absorbed from the exterior to be discharged to the interior.

The heat exchange system typically includes an evaporator which absorbs heat from ambient surroundings, a compressor which compresses a refrigerant, a heat exchanger which discharges heat to ambient surroundings, and an expansion valve which expands a refrigerant.

In the cooling system, a liquid refrigerant is evaporated by absorbing a quantity of heat equivalent to the heat of vaporization from ambient surroundings by means of the evaporator, thereby resulting in actual cooling action.

The gas refrigerant introduced to the compressor from the evaporator is compressed to high temperature and high pressure, and the heat of liquefaction is discharged to ambient surroundings when the compressed gas refrigerant is liquefied while passing through the heat exchanger.

In addition, a cycle is configured in such a manner that the liquefied refrigerant becomes a wet saturated steam having low-temperature and low-pressure by passing through the expansion valve again, and is then introduced back into the evaporator to be vaporized.

As such, the heat of liquefaction is discharged from the high-temperature and high-pressure gas refrigerant introduced into the heat exchanger through heat exchange therein, so that the refrigerant is condensed into a liquid phase and is then discharged.

That is, a condenser performs a function that exchanges heat between the high-temperature and high-pressure gas refrigerant discharged from the compressor and outside air so that the refrigerant is condensed into a liquid phase.

The last row of the condenser is provided with a support having a protruding portion which is formed so as to facilitate the brazing of a radiation fin and prevent the separation of the radiation fin.

The support is formed with the protruding portion by a press method or a roll forming method.

However, the conventional support having the protruding portion is problematic in that, when the protruding portion is randomly formed on the support and is formed such that the starting point of the protruding portion is connected to a coupling portion on the support, the clad on a header of a header tank is melted during the brazing of the radiation fin to thereby melt the radiation fin while flowing along the protruding portion.

In addition, the conventional support having the protruding portion is problematic in that the clad on the header melts the radiation fin during the brazing thereof, and thus the failure rate of the condenser is increased.

Moreover, there is a problem in that, when the radiation fin is attached to the vehicle in the state in which it is not perfectly melted, the efficiency of the condenser is reduced and the appearance thereof is poor.

Furthermore, in the press method for manufacturing the support, the starting point of the protruding portion may be adjusted. However, a separate press mold must be manufactured since the press mold is changed whenever supports having different lengths are manufactured. For this reason, the time and cost for manufacturing the support may be increased.

Finally, in the roll forming method for manufacturing the support, there is no need to separately manufacture the mold depending on the length of the support. However, since the starting point of the protruding portion may not be arbitrarily adjusted, many problems are still present.

SUMMARY OF THE INVENTION

An object of the present invention is to provide a vehicle condenser in which a notch portion of each coupling part of a pair of supports installed at the outermost sides of radiation fins extends so as to have a certain length from the tip of a body part to the inside end of the notch portion, or a through-hole is formed so as to be spaced by a predetermined distance toward the inside of the body part from the tip thereof, thereby preventing the radiation fins from melting when the clad on a header of a header tank is melted during the brazing of the radiation fins and flows along an embossing part, regardless of a method for manufacturing the supports. Consequently, it is possible to reduce the failure rate of the condenser and increase the efficiency of the condenser by maintaining the original state of the radiation fins.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, a vehicle condenser includes a pair of header tanks (10 and 20) installed so as to be spaced transversely apart from each other, a plurality of tubes (30) stacked so as to be spaced longitudinally apart from each other while both ends of each of the tubes are inserted into the header tanks (10 and 20), a plurality of radiation fins (40) installed between the tubes (30), and a pair of supports (50 and 60) installed such that one surface of each of the supports comes into contact with the associated outermost one of the radiation fins (40) while both ends of each of the supports are inserted into the header tanks (10 and 20), wherein each of the supports (50 and 60) includes a body part (100) extending transversely, an embossing part (200) protruding from the other surface of the body part (100) which does not come into contact with the radiation fins (40), and coupling parts (300) extending outward from both tips (120) of the body part (100).

The embossing part (200) may consist of a plurality of embossing parts formed so as to be spaced transversely at a certain interval on a central axis line (110) of the body part (100).

Each of the coupling parts (300) may include a notch portion (310) formed inward of the body part (100) from a tip of the coupling part (300) so as to be located on the central axis line (110) of the body part (100), and a fork portion (320) inserted into each of support insertion holes (13 and 23) formed in the header tanks (10 and 20).

The notch portion (310) may be tapered such that a width (W) thereof is reduced toward an inside end (311) of the notch portion (310) from a tip (321) of the fork portion (320).

The notch portion (310) may be formed such that the inside end (311) thereof is round.

The notch portion (310) may be formed so as to have a length (L) of 3 mm or more from the tip (120) of the body part (100) to the inside end (311) of the notch portion (310).

The tip (321) of the fork portion (320) may have an outer surface (322) tapered such that a width (w) of the fork portion (320) is increased toward the tip (120) of the body part (100) from the tip (321) of the fork portion (320).

The coupling parts (300) may further include flange portions (330) extending so as to be bent in a width direction of the body part (100) from both tips (120) thereof.

Each of the supports (50 and 60) may further include through-holes (400), each penetrating the body part (100) so as to be spaced by a predetermined distance (1) toward the inside of the body part (100) from each of both tips (120) thereof.

Each of the through-holes (400) may have a circular or square shape.

The through-holes (400) may be formed so as to be located on a central axis line (110) of the body part (100).

Each of the through-holes (400) may be located at a position spaced by a distance (1) of 1 mm to 5 mm toward the inside of the body part (100) from each of both tips (120) thereof.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
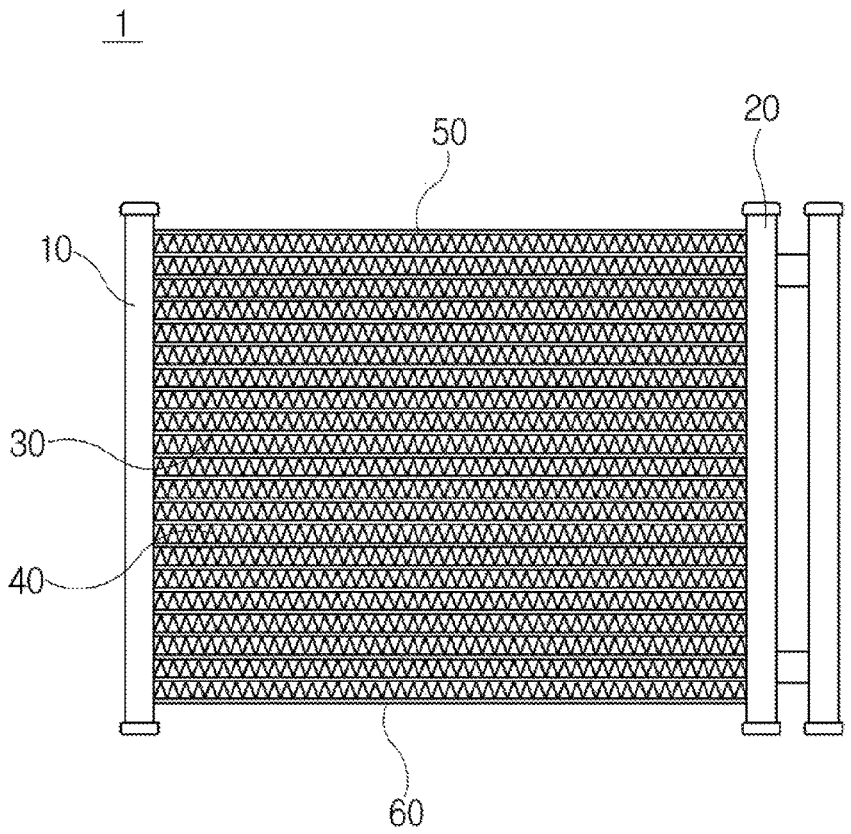
FIG. 1 is a perspective view illustrating a vehicle condenser according to an embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Figure 2:
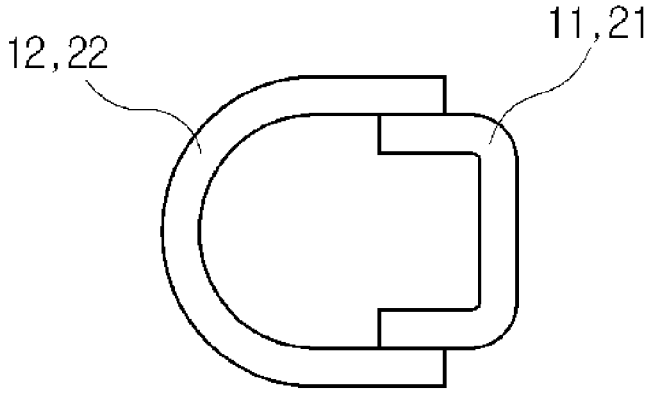
FIG. 2 is a cross-sectional view illustrating one header tank.
Figure 3:
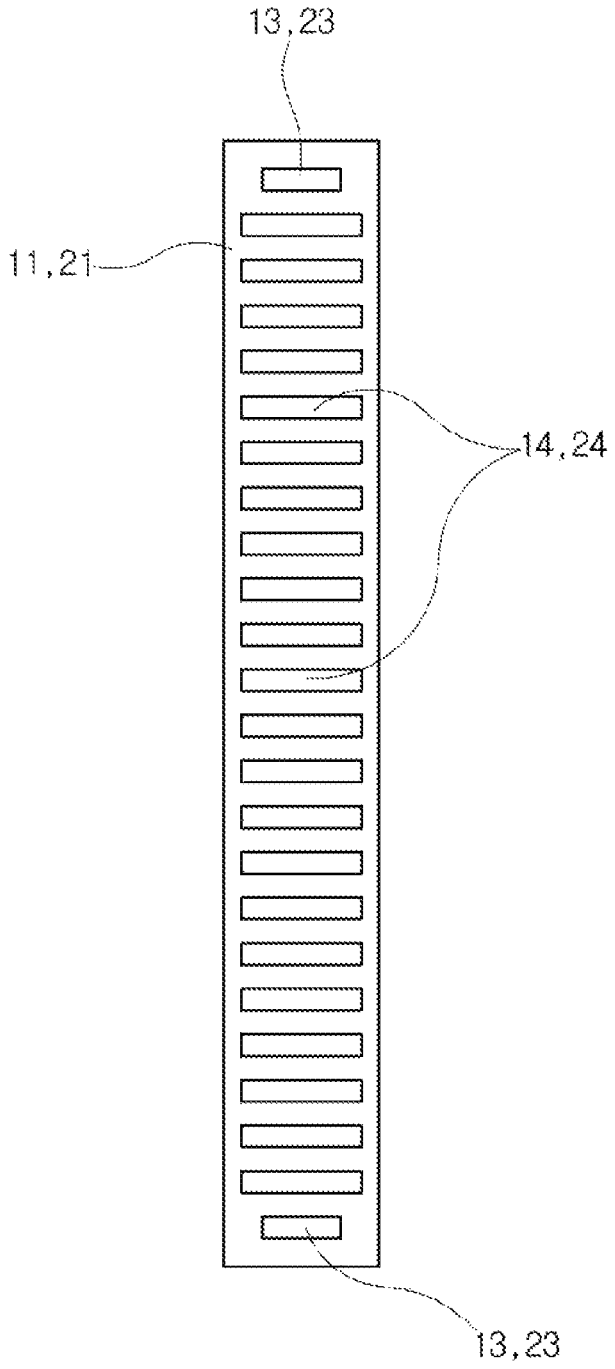
FIG. 3 is a side view illustrating the header tank.
Figure 4:
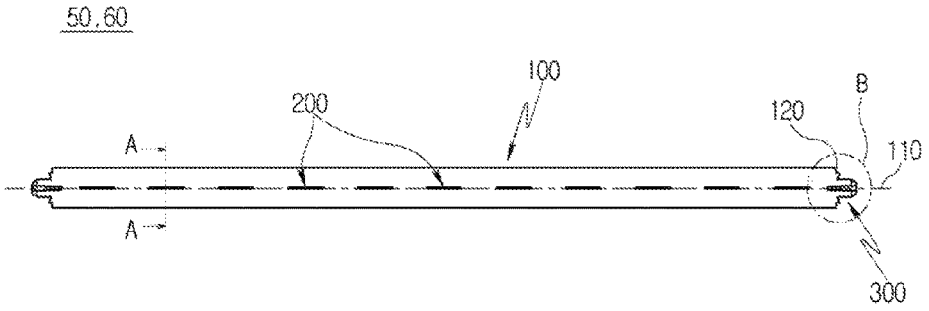
FIG. 4 is a top view illustrating one support installed to the vehicle condenser according to the embodiment of the present invention.
Figure 5:
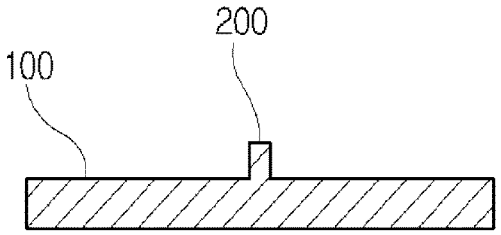
FIG. 5 is a cross-sectional view taken along line "A-A" of FIG. 4.
Figure 6:
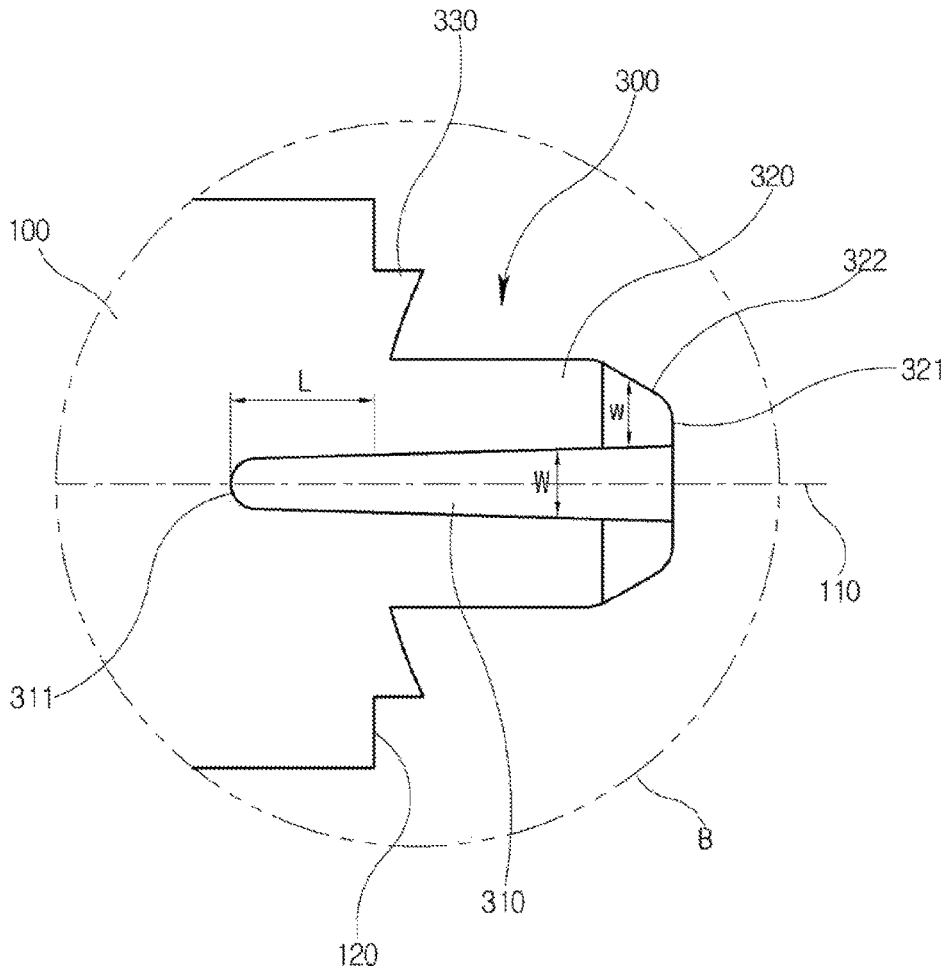
FIG. 6 is an enlarged view illustrating portion "B" of FIG. 4.
Figure 7:
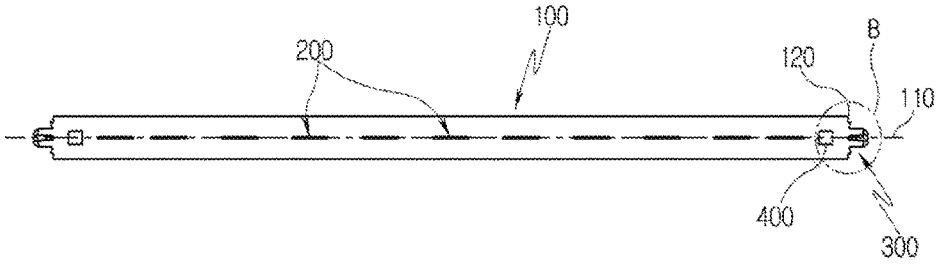
FIG. 7 is a top view illustrating one support installed to a vehicle condenser according to another embodiment of the present invention.
Figure 8:
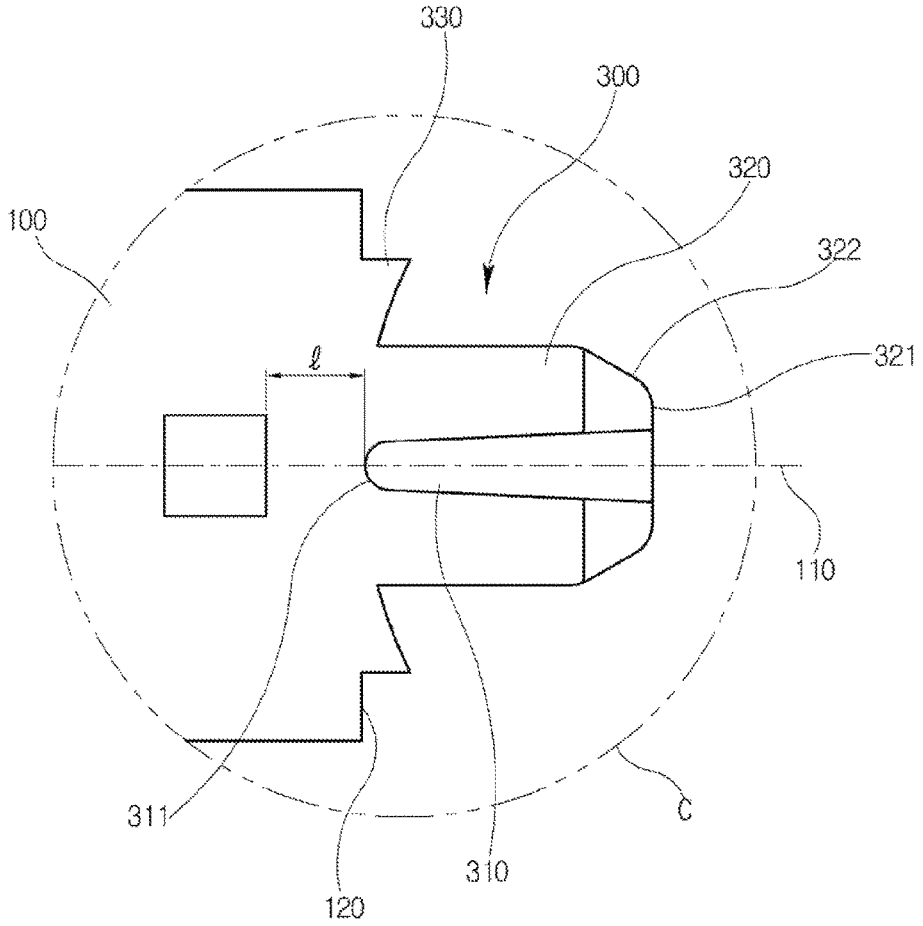
FIG. 8 is an enlarged view illustrating portion "C" of FIG. 7.

FIG. 1 is a perspective view illustrating a vehicle condenser according to an embodiment of the present invention. FIG. 2 is a cross-sectional view illustrating one header tank. FIG. 3 is a side view illustrating the header tank. FIG. 4 is a top view illustrating one support installed to the vehicle condenser according to the embodiment of the present invention. FIG. 5 is a cross-sectional view taken along line "A-A" of FIG. 4. FIG. 6 is an enlarged view illustrating portion "B" of FIG. 4. FIG. 7 is a top view illustrating one support installed to a vehicle condenser according to another embodiment of the present invention. FIG. 8 is an enlarged view illustrating portion "C" of FIG. 7.

The terms used in the present disclosure are as follows. The term "transverse (direction)" refers to a horizontal direction in which a first header tank 10 is spaced apart from a second header tank 20, and the term "longitudinal (direction)" refers to a vertical direction from one end of the first or second header tank 10 or 20 to the other end thereof. The term "width direction" refers to a direction perpendicular to the transverse direction, rather than the longitudinal direction. The term "upper portion" refers to an upper side in the longitudinal direction, and the term "lower portion" refers to a lower side in the longitudinal direction. The term "front" refers to a direction in which a grill is located in an engine room equipped with a condenser 1 including a heat exchanger.

The condenser 1 according to the embodiment of the present invention will be described with reference to FIGS. 1 to 8.

The vehicle condenser 1 according to the embodiment of the present invention includes a pair of header tanks 10 and 20, a plurality of tubes 30, a plurality of radiation fins 40, and a pair of supports 50 and 60.

The pair of header tanks 10 and 20 is installed so as to be spaced transversely apart from each other.

As illustrated in FIG. 2, the first and second header tanks 10 and 20 constituting the pair of header tanks 10 and 20 are formed by coupling first and second headers 11 and 12 to first and second tanks 12 and 22, respectively. That is, the first and second header tanks 10 and 20, which are formed by respectively coupling the first and second headers 11 and 12 to the first and second tanks 12 and 22, are installed so as to be spaced transversely at a certain interval and be vertically parallel with each other.

As illustrated in FIG. 3, the first and second headers 11 and 12 of the respective first and second header tanks 10 and 20 have a plurality of slit portions 14 and 24 formed so as to be spaced longitudinally at a certain interval such that the ends of the tubes 30 are inserted into the slit portions. In addition, the first and second headers 11 and 12 of the respective first and second header tanks 10 and 20 are formed with support insertion holes 13 and 23 which are spaced apart from the slit portions 14 and 24 formed at the uppermost sides of the respective first and second headers 11 and 21 and the slit portions 14 and 24 formed at the lowermost sides thereof.

Although not illustrated in the drawings, an inlet pipe is formed at the first or second header tank 10 or 20, and a refrigerant is introduced through the inlet pipe. In addition, an outlet pipe is formed at the first or second header tank 10 or 20 so as to be spaced longitudinally apart from the inlet pipe formed at the first or second header tank 10 or 20, and a refrigerant is discharged through the outlet pipe. That is, when the inlet pipe is formed at the first header tank 10, the outlet pipe is also formed at the first header tank 10. On the contrary, when the inlet pipe is formed at the second header tank 20, the outlet pipe is also formed at the second header tank 20.

The tubes 30 are stacked so as to be spaced longitudinally at a certain interval in the state in which both ends thereof are inserted into the slit portions 14 and 24 of the first and second header tanks 10 and 20. That is, the tubes 30 are stacked so as to be spaced longitudinally at a certain interval while both ends thereof are fixed to the first and second header tanks 10 and 20, and a refrigerant passage is formed in each of the tubes.

The radiation fins 40 are installed between the tubes 30. That is, the radiation fins 40 are formed between two adjacent tubes 30, which are longitudinally stacked, while being vertically bent at the uppermost and lowermost tubes, thereby increasing a heat transfer area with air flowing between the tubes 30.

The refrigerant exchanges heat with outside air by each radiation fin 40 having an increased heat transfer area while moving in each of the tubes 30.

The vehicle condenser 1 according to the embodiment of the present invention may include a receiver drier which communicates with the first or second header tank 10 or 20 through inlet and outlet portions formed at one side of the first or second header tank 10 or 20.

Although the respective first and second header tanks 10 and 20 are illustrated to be located at left and right sides in FIG. 1, the present invention is not necessarily limited thereto. The respective first and second header tanks 10 and 20 may be installed to right and left sides as occasion demands. That is, when the first header tank 10 is installed to the right side, the inlet and outlet pipes are also installed to the right sides, and the receiver drier is installed at one side of the second header 20 which is installed to the left side.

When the inlet and outlet pipes are formed at the first header tank 10, the receiver drier is formed at the second header tank 20. On the contrary, when the inlet and outlet pipes are formed at the second header tank 20, the receiver drier is formed at the first header tank 10. That is, the inlet and outlet pipes and the receiver drier are formed at the different header tanks.

The pair of supports 50 and 60 is installed such that both ends thereof are inserted into the support insertion holes 13 and 23 of the pair of header tanks 10 and 20, and one surface of each thereof comes into contact with the associated outermost one of the radiation fins 40. That is, the first support 50 is installed across the upper portions of the first and second header tanks 10 and 20 such that the lower surface of the first support 50 comes into contact with the radiation fin 40 formed at the upper portion of the uppermost tube 30. In addition, the second support 60 is installed across the lower portions of the first and second header tanks 10 and 20 such that the upper surface of the second support 60 comes into contact with the radiation fin 40 formed at the lower portion of the lowermost tube 30.

Each of the first and second supports 50 and 60 constituting the pair of supports 50 and 60 includes a body part 100, an embossing part 200, and coupling parts 300.

The body part 100 extends transversely by a distance equal to the spacing between the pair of the header tanks 10 and 20, and has a plate shape that has a width equal to or slightly greater than the width of each radiation fin 40.

As illustrated in FIG. 5, the embossing part 200 protrudes from the other surface of the body part 100 which does not come into contact with the radiation fins 40. The embossing part 200 is formed by a press method or a roll forming method so as to protrude from one surface of the body part 100.

In addition, as illustrated in FIGS. 4 and 7, the embossing part 200 consists of a plurality of embossing parts formed so as to be spaced transversely at a certain interval on the central axis line 110 of the body part 100. Since the embossing parts 200 are formed so as to be spaced transversely at a certain interval on the central axis line 110 on one surface of the body part 100, it is possible to easily perform the brazing of the radiation fins 40 and prevent the separation thereof.

Each of the coupling parts 300 extends outward from each of both tips 120 of the body part 100. That is, the coupling part 300 extends outward from each of the header tanks.

As illustrated in FIGS. 6 and 8, each of the coupling parts 300 of each support 50 or 60 of the vehicle condenser 1 according to the embodiment of the present invention includes a notch portion 310 and a fork portion 320.

The notch portion 310 is formed inward of the body part 100 from the tip of the coupling part 300 so as to be located on the central axis line 110 of the body part 100.

The fork portion 320 has a symmetrical shape about the central axis line 110 of the body part 100 by the notch portion 310. The fork portion 320 is inserted into the associated support insertion hole 13 or 23 in each of the header tanks 10 and 20 so as to fix the supports 50 and 60 to the header tanks 10 and 20.

As illustrated in FIGS. 6 and 8, each of the coupling parts 300 of each support 50 or 60 of the vehicle condenser 1 according to the embodiment of the present invention may further include a flange portion 330.

The flange portion 330 extends so as to be bent in the width direction of the body part 100 from each of both tips 120 thereof. The flange portion 330 has a curvature equal to or slightly greater than the outer diameter of the first or second header 11 or 12 of each of the first and second header tanks 10 and 20, but the present invention is not necessarily limited thereto. Thus, when the fork portion 320 is inserted into the associated support insertion hole 13 or 23, the flange portion 330 is supported so as to come into contact with both ends of the support insertion hole 13 or 23 in the width direction thereof. Consequently, it is possible to easily couple the supports 50 and 60 by the flange portions 330 and to increase the coupling force thereof.

As illustrated in FIGS. 4 and 6, the notch portion 310 of each coupling part 300 of each support 50 or 60 of the vehicle condenser 1 according to the embodiment of the present invention is tapered such that the width W of the notch portion 310 is reduced toward the inside end 311 of the notch portion 310 from the tip 321 of the fork portion 320. That is, the width W of the notch portion 310 is gradually reduced as the notch portion 310 is directed inward from the outside of the support. Thus, it is possible to prevent the radiation fins from melting when the clad on the header of each header tank falls along the side of the notch portion while melting and flowing during the brazing of the radiation fins.

In addition, as illustrated in FIGS. 4 and 6, the notch portion 310 is formed such that the inside end 311 thereof is round. Since the inside end 311 of the notch portion 310 is formed to be round, the clad on the header of the header tank does not fall along the side of the notch portion while melting and flowing during the brazing of the radiation fins, but is collected in the inside end 311. As a result, it is possible to prevent the radiation fins from melting due to the falling of the clad by gravity.

As illustrated in FIGS. 4 and 6, the notch portion 310 of each coupling part 300 of each support 50 or 60 of the vehicle condenser 1 according to the embodiment of the present invention is formed so as to have a length L of 3 mm or more from the tip 120 of the body part 100 to the inside end 311 of the notch portion 310. When the length L from the tip 120 of the body part 100 to the inside end 311 of the notch portion 310 is less than 3 mm, the clad on the header of the header tank does not fall along the side of the notch portion while melting and flowing during the brazing of the radiation fins. For this reason, it is impossible to prevent the radiation fins 40 from melting. In addition, when the length L from the tip 120 of the body part 100 to the inside end 311 of the notch portion 310 exceeds 12 mm, the coupling part 300 may be damaged due to vibration of the vehicle since the durability of the coupling part 300 is deteriorated.

Accordingly, the notch portion of the coupling part of the support extends so as to have a certain length from the tip of the body part to the inside end of the notch portion, thereby preventing the radiation fins from melting when the clad on the header of the header tank is melted during the brazing of the radiation fins and flows along the embossing part, regardless of the method for manufacturing the supports. Therefore, it is possible to reduce the failure rate of the condenser and increase the efficiency of the condenser by maintaining the original state of the radiation fins.

As illustrated in FIGS. 4 and 6, the outer surface 322 of the tip 321 of the fork portion 320 of each coupling part 300 of each support 50 or 60 of the vehicle condenser 1 according to the embodiment of the present invention is tapered such that the width w of the fork portion 320 is increased toward the tip 120 of the body part 100 from the tip 321 of the fork portion 320. Thus, since the fork portion 320 is easily inserted into the associated support insertion hole 13 or 23 by the tapered outer surface 322 of the fork portion 320, the time for assembling supports can be reduced.

As illustrated in FIGS. 7 and 8, each support 50 or 60 of a vehicle condenser 1 according to another embodiment of the present invention includes through-holes 400.

Each of the through-holes 400 penetrates the body part 100 so as to be spaced by a predetermined distance 1 toward the inside of the body part 100 from each of both tips 120 thereof. Although the through-hole 400 is illustrated to have a square shape in FIGS. 7 and 8, the present invention is not necessarily limited thereto. For example, the through-hole 400 may have various shapes such as a circular shape, an oval shape, and a cylindrical shape, as occasion demands.

The through-hole 400 is formed so as to be located on the central axis line 110 of the body part 100. That is, the through-hole 400 penetrates the body part 100 so as to have a symmetrical shape about the central axis line 110 of the body part 100 in the vertical direction thereof.

The through-hole 400 is located at a position spaced by a distance 1 of 1 mm to 5 mm toward the inside of the body part 100 from each of both tips 120 thereof. When the through-hole 400 is located at a position spaced by the distance 1 less than 1 mm toward the inside of the body part 100 from the tip 120 thereof, the coupling part 300 may be damaged due to vibration of the vehicle since the durability of the coupling part 300 is deteriorated. In addition, when the through-hole 400 is located at a position spaced by the distance 1 greater than 5 mm toward the inside of the body part 100 from the tip 120 thereof, the clad on the header of the header tank does not fall while melting and flowing during the brazing of the radiation fins. For this reason, it is impossible to prevent the radiation fins from melting.

Accordingly, the through-hole is formed so as to be spaced by a predetermined distance toward the inside of the body part from the tip thereof, thereby preventing the radiation fins from melting when the clad on the header of the header tank is melted during the brazing of the radiation fins and flows along the embossing part, regardless of the method for manufacturing the supports. Therefore, it is possible to reduce the failure rate of the condenser and increase the efficiency of the condenser by maintaining the original state of the radiation fins.

As is apparent from the above description, according to a vehicle condenser of the present invention, a notch portion of each coupling part of a pair of supports installed at the outermost sides of radiation fins extends so as to have a certain length from the tip of a body part to the inside end of the notch portion, or a through-hole is formed so as to be spaced by a predetermined distance toward the inside of the body part from the tip thereof, thereby preventing the radiation fins from melting when the clad on a header of a header tank is melted during the brazing of the radiation fins.

In addition, according to the vehicle condenser of the present invention, it is possible to prevent the radiation fins from melting and reduce the failure rate of the condenser, and the vehicle condenser can have an aesthetic appearance.

In addition, according to the vehicle condenser of the present invention, it is possible to increase the efficiency of the condenser by maintaining the original state of the radiation fins.

In addition, according to the vehicle condenser of the present invention, it is possible to prevent the radiation fins from melting when the clad on the header of the header tank is melted, regardless of the method for manufacturing the supports.

While the present invention has been described with respect to the specific embodiments, it will be apparent to those skilled in the art that various changes and modifications may be made without departing from the spirit and scope of the invention as defined in the following claims.

What is claimed is:

1. A vehicle condenser comprising:

a pair of header tanks (10, 20) installed so as to be spaced transversely apart from each other;

a plurality of tubes (30) stacked so as to be spaced longitudinally apart from each other while both ends of each of the tubes are inserted into the header tanks (10, 20);

a plurality of radiation fins (40) installed between the tubes (30); and a pair of supports (50, 60) installed such that one surface of each of the supports comes into contact with an associated outermost one of the radiation fins (40) while both ends of each of the supports are inserted into the header tanks (10, 20), wherein each of the supports (50, 60) comprises:

a body part (100) extending transversely;

an embossing part (200) protruding from another surface of the body part (100) which does not come into contact with the radiation fins (40); and coupling parts (300) extending outward from both tips (120) of the body part (100), each of the coupling parts (300) including a fork portion (320) and a notch portion (310), wherein the notch portion (310) is formed by inwardly cutting out of the body part (100) from a tip (321) of the fork portion of each of the coupling parts (300) to locate the notch portion (310) on a central axis line (110) of the body part (100), wherein the notch portion (310) is tapered wherein a width (W) thereof is gradually reduced at a constant rate toward an inside end (311) along an entire length of the notch portion (310) from the tip (321) of the fork portion (320) to the inside end (311) of the notch portion (310), wherein the fork portion (320) is inserted into a support insertion hole (13, 23) formed in a corresponding one of the header tanks (10, 20), and wherein the inside end (311) of the notch portion (310) is disposed externally to and at a distance from the corresponding one of the header tanks (10, 20) when the fork portion (320) is inserted into the support insertion hole (13, 23) of the corresponding one of the header tanks (10, 20).

2. The vehicle condenser according to claim 1, wherein the embossing part (200) consists of a plurality of embossing parts formed so as to be spaced transversely at a certain interval on the central axis line (110) of the body part (100).

3. The vehicle condenser according to claim 1, wherein the notch portion (310) is formed such that the inside end (311) thereof is round.

4. The vehicle condenser according to claim 3, wherein the notch portion (310) is formed so as to have a length (L) of 3 mm or more from the tip (120) of the body part (100) to the inside end (311) of the notch portion (310).

5. The vehicle condenser according to claim 4, wherein the tip (321) of the fork portion (320) has an outer surface (322) tapered such that a width (w) of the fork portion (320) is increased toward the tip (120) of the body part (100) from the tip (321) of the fork portion (320).

6. The vehicle condenser according to claim 1, wherein the coupling parts (300) further comprise flange portions (330) extending so as to be bent in a width direction of the body part (100) from both of the tips (120) thereof.

* * * * *